United States Patent [19]

Arnsperger et al.

[11] 4,424,830

[45] Jan. 10, 1984

[54] GAS VALVE

[75] Inventors: Preston R. Arnsperger; John J. Love, both of St. Louis County, Mo.

[73] Assignee: Emerson Electric Co., St. Louis, Mo.

[21] Appl. No.: 331,144

[22] Filed: Dec. 16, 1981

[51] Int. Cl.[3] ..... F23N 5/00

[52] U.S. Cl. ..... 137/613; 137/269; 251/367

[58] Field of Search ..... 137/613, 505, 269, 66, 137/65; 251/367; 29/157.1 R

[56] References Cited

U.S. PATENT DOCUMENTS

| | | | |
|---|---|---|---|
| 2,587,480 | 2/1952 | Johnston et al. | 137/269 |
| 2,650,617 | 9/1953 | Wasser | 137/719 |
| 2,856,569 | 10/1958 | Birge | 317/186 |
| 2,904,068 | 9/1959 | St. Clair | 251/367 |
| 2,999,192 | 9/1961 | Lambert | 317/191 |
| 3,190,310 | 6/1965 | Honsinger | 251/367 |
| 3,446,227 | 5/1969 | Grayson | 137/269 |
| 3,496,951 | 2/1970 | Stang, Jr. et al. | 137/269 |
| 3,497,849 | 2/1970 | Place et al. | 337/99 |
| 3,597,139 | 8/1971 | Elders | 431/66 |
| 4,044,794 | 8/1977 | Matthews | 137/613 |

*Primary Examiner*—A. Michael Chambers
*Attorney, Agent, or Firm*—Paul A. Becker, Sr.

[57] ABSTRACT

A gas valve device includes a pressure regulator and two solenoid operated valves connected fluidically in series. The valve body therein is selectively cored and machined so as to provide a gas valve device which is compact in physical size, inexpensive to produce, and versatile in that it provides a choice of several gas outlet directions.

4 Claims, 15 Drawing Figures

GAS VALVE

BACKGROUND OF THE INVENTION

This invention relates to gas valves, and particularly to an improved construction thereof which results in a compact and versatile device.

Gas valves comprising a pressure regulator and two solenoid operated valves, all connected fluidically in series with a burner, have been known for many years. Such valves, in conjunction with externally connected electrical circuitry, are utilized to control gas flow to various gas-fired appliances, such as clothes dryers.

SUMMARY OF THE INVENTION

An object of this invention is to provide a generally new and improved gas valve comprising a pressure regulator and two solenoid operated valves which is compact in physical size, versatile in providing a choice of several gas outlet directions, and relatively inexpensive to produce.

A further object is to provide a compact gas valve comprising a pressure regulator and two solenoid operated valves wherein the metal casting for the valve body is cored in such a manner that a minimal amount of machining is required to provide a desired gas outlet direction.

The above-mentioned and other objects and features of the present invention will become apparent from the following description when read in conjunction with the accompanying drawings.

DESCRIPTION OF THE PREFERRED EMBODIMENT

Figure 1:
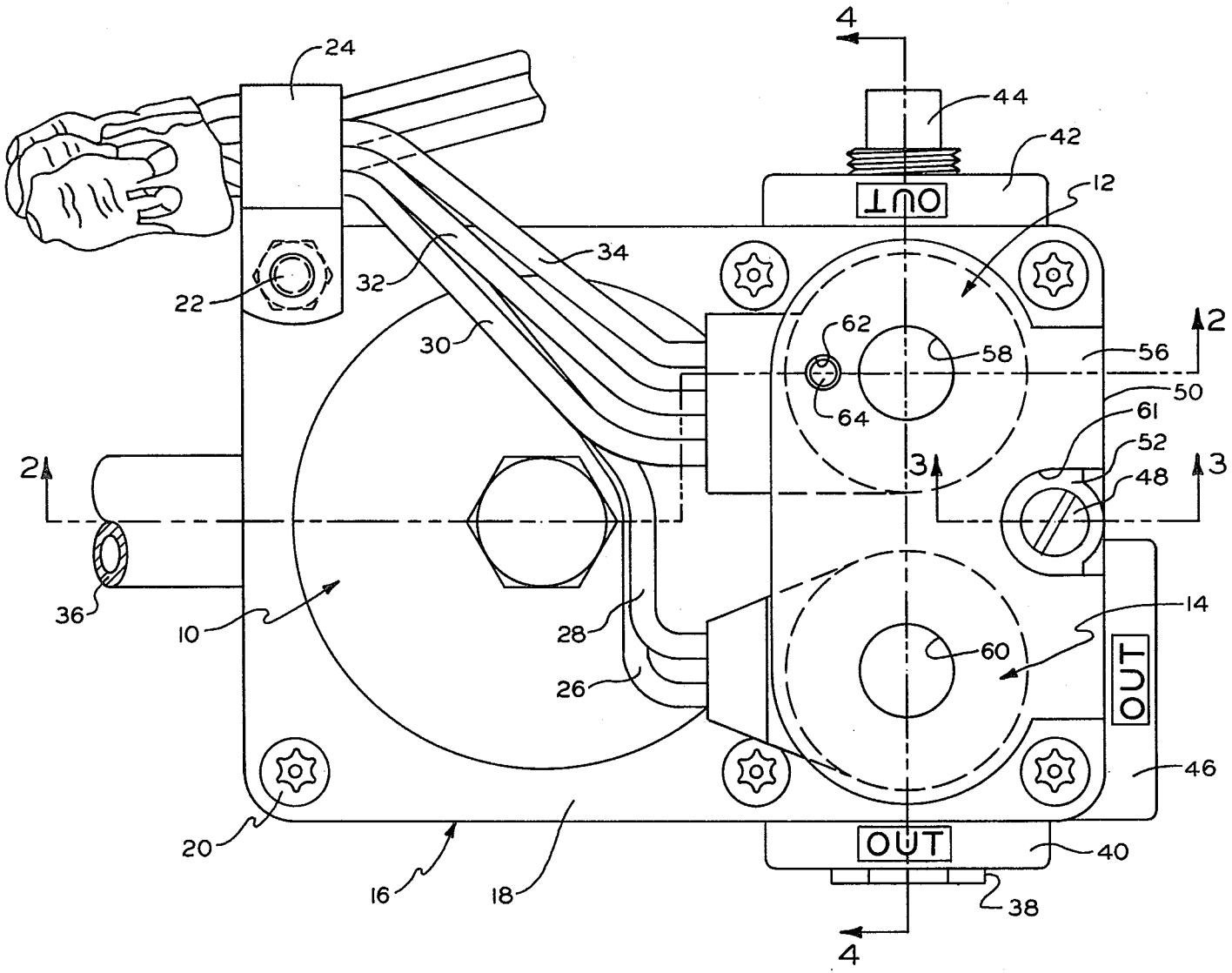
FIG. 1 is an enlarged top plan view of the gas valve constructed in accordance with the present invention.

Referring to FIG. 1, the gas valve of this invention includes a pressure regulator indicated generally at 10 and two solenoid operated valves indicated generally at 12 and 14 positioned in a single valve body indicated generally at 16. A cover plate 18 is attached to valve body 16 by a plurality of tamper-proof screws 20 and by a special screw 22 threaded on one end for attaching cover plate 18 to valve body 16 and on its other end for frictionally mounting a cable clamp 24. Clamp 24 is provided for retaining a plurality of electrical leads including a pair of leads 26 and 28 connected to solenoid operated valve 14 and three leads 30, 32 and 34 connected to solenoid operated valve 12.

Gas flows into valve body 16 via a gas inlet conduit 36 and exits valve body 16 through an orifice screw 38 threadedly engaged in an outlet boss 40 of valve body 16. Threadedly engaged in another outlet boss 42 of valve body 16 is a conventional pressure tap fitting 44. A third outlet boss 46 is provided in valve body 16 for reasons hereinafter described.

Figure 2:
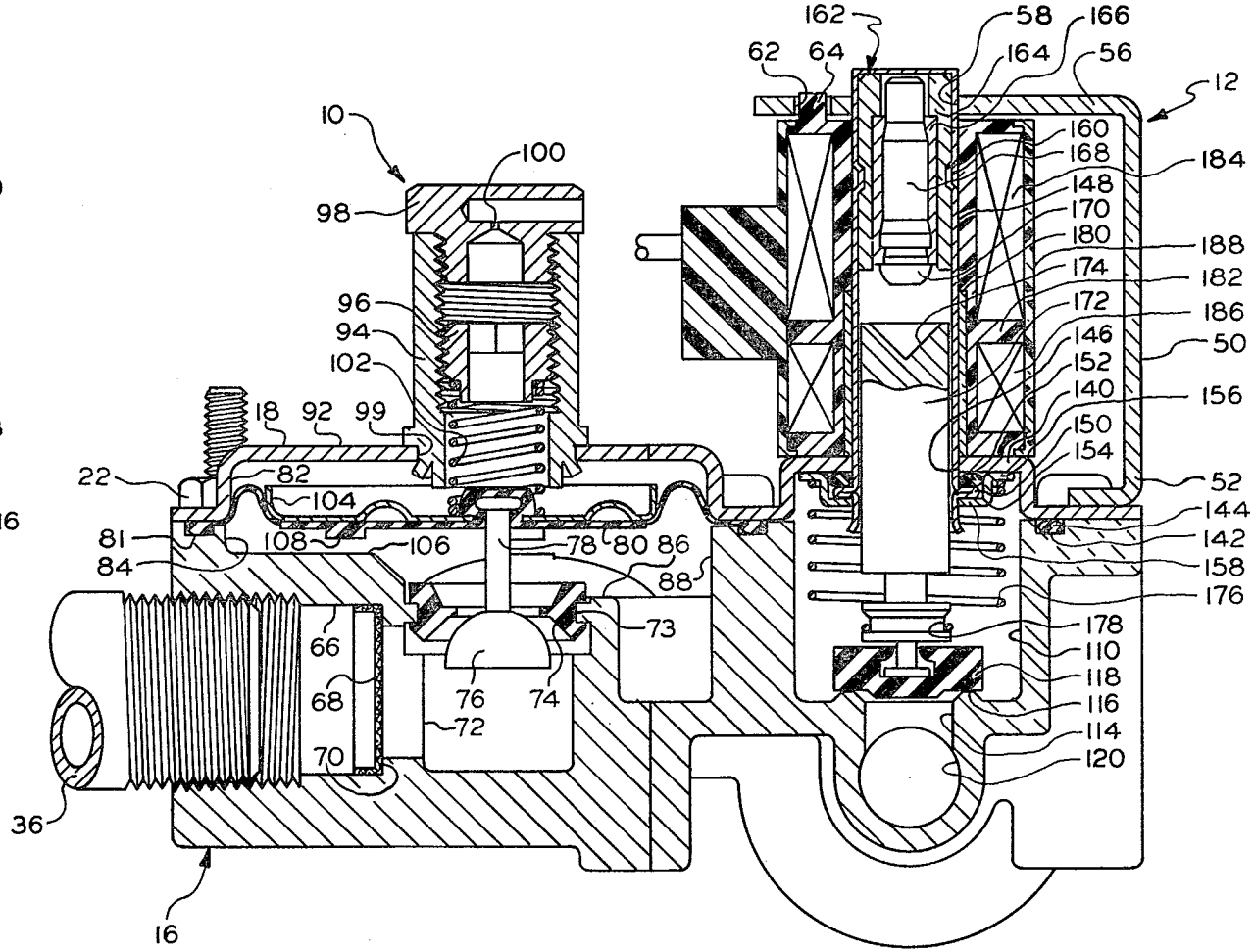
FIG. 2 is an enlarged cross-sectional view taken along line 2—2 of FIG. 1 with various electrical leads and a cable clamp removed.
Figure 3:
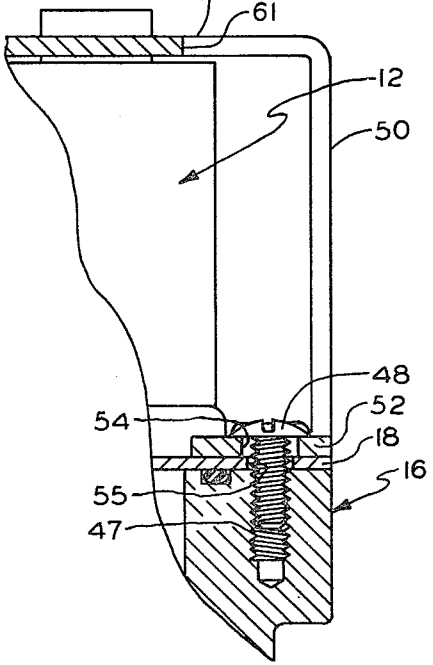
FIG. 3 is an enlarged partial cross-sectional view taken along line 3—3 of FIG. 1.

Attached to one of a plurality of threaded apertures 47 in valve body 16 by a screw 48 is a U-shaped bracket 50 which functions as a portion of the magnetic path for solenoid operated valves 12 and 14. Referring to FIGS. 1, 2, and 3, a bottom leg 52 of bracket 50 is provided with an aperture 54, in alignment with an aperture 55 in cover plate 18, through which screw 48 extends for attachment of bracket 50 to valve body 16. A top leg 56 of bracket 50 is provided with two apertures 58 and 60 through which portions of valves 12 and 14, respectively, extend. A vertical slot 61 extends from top leg 56 to bottom leg 52 to enable access to screw 48. Top leg 56 is also provided with an aperture 62 through which a projecting boss 64 of a portion of valve 12 extends. The cooperation of aperture 62 in top leg 56 and projecting boss 64 of a portion of valve 12 ensures that, should one or more of the windings of valves 12 and 14 be replaced, bracket 50 can only be attached if the correct windings are on valves 12 and 14.

Referring now to FIG. 2, valve body 16 is provided with a threaded and stepped opening 66 for receiving inlet conduit 36. A small-mesh screen 68 is located against a shoulder 70 in opening 66 downstream of inlet conduit 36 for trapping any foreign particles, such as dirt or metal chips, that may be present in the gas stream. Contiguous with opening 66 is a chamber 72, one end of which is provided with a ledge 73 to which a valve seat 74 is attached.

Pressure regulator 10 is effective to control the rate of gas flow out of chamber 72. Regulator 10 includes a poppet valve 76 cooperative with valve seat 74 and connected by a valve stem 78 to a flexible diaphragm 80.

A peripheral portion of diaphragm 80 is located in a groove 81 of valve body 16 and is sandwiched between valve body 16 and cover plate 18. Diaphragm 80 forms a flexible wall between an upper chamber 82 and a lower chamber 84 of regulator 10. Lower chamber 84 is defined by diaphragm 80 and a recess formed in valve body 16, the recess having a bottom wall 86 and a side wall 88 having a passageway 90, shown in FIG. 4, through which gas flows to the burner (not shown)

when solenoid operated valves 12 and 14 are energized, as will be hereinafter described.

The upper chamber 82 of regulator 10 is defined by diaphragm 80 and a recess formed by a cup-shaped portion 92 of cover plate 18, an internally-threaded sleeve 94, a spring-adjusting screw 96, and a fixed-orifice screw 98. Sleeve 94 is staked to cup-shaped portion 92 of cover plate 18 at a centrally located aperture 99 therein. Screw 98 is threadedly attached to the interior of sleeve 94 and is provided with a small-diameter opening 100 to cause upper chamber 82 to be exposed to atmospheric pressure. Screw 96 is threadedly attached to the interior of sleeve 94 and enables adjustment of a spring 102 which biases diaphragm 80 downwardly. A relatively rigid disc 104 is centrally positioned and attached to diaphragm 80. Disc 104 aids in securing valve stem 78 to diaphragm 80, provides a rigid nesting surface for one end of spring 102, and imparts rigidity to diaphragm 80.

Valve body 16 in lower chamber 84 is provided with three peripherally-shaped bosses 106 projecting upwardly from bottom wall 86. These bosses 106 limit downward movement of diaphragm 80 so as to ensure that diaphragm 80 will not restrict or throttle the gas flow past valve seat 74 when gas pressure is relatively low. The underside of diaphragm 80 is provided with three projections 108 which are vertically aligned with boses 106. These projections 108, which further limit downward movement of diaphragm 80, also prevent damage to the relatively thin diaphragm 80 that could otherwise occur due to vibration when diaphragm 80 and bosses 106 are normally in contact, such as during shipment.

Figure 4:
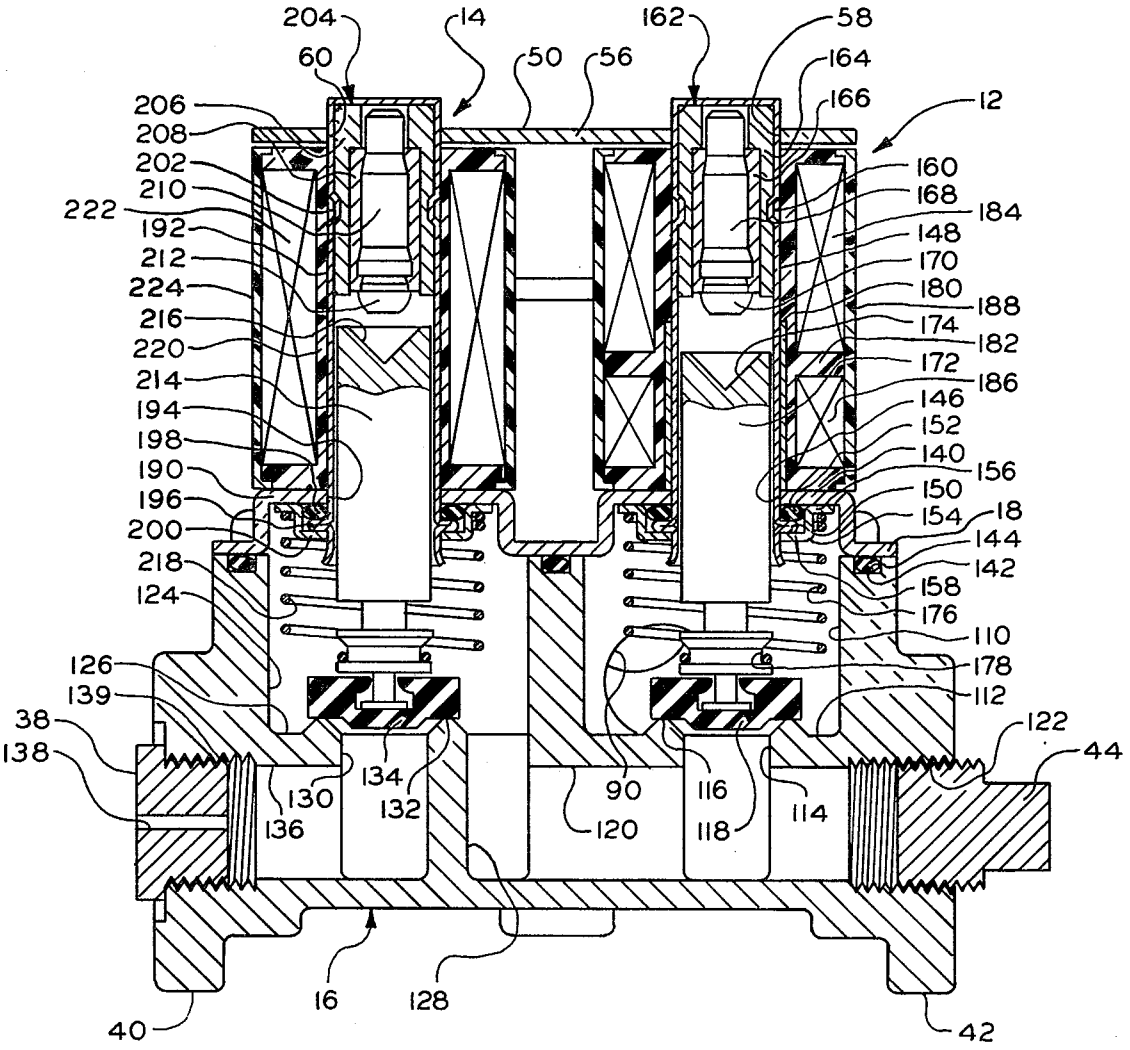
FIG. 4 is an enlarged cross-sectional view taken along line 4—4 of FIG. 1 with various electrical leads and a cable clamp removed.

Referring now to FIG. 4, passageway 90 is contiguous with a chamber 110 formed as a recess in valve body 16. A bottom wall 112 of chamber 110 is provided with a passageway 114 having a valve seat 116 formed at the entrance thereof. A valve 118 of solenoid operated valve 12 cooperates with valve seat 116 to control the flow of gas between chamber 110 and passageway 114. When valve 118 is open, gas flows through passageway 114 into a passageway 120. Pressure tap fitting 44 is attached to a threaded opening 122 in one end of passageway 120. The other end of passageway 120 leads into a chamber 124.

Chamber 124 is also formed as a recess in valve body 16. A bottom wall 126 of chamber 124 is provided with a recessed opening 128 for reasons hereinafter described. The bottom wall 126 is also provided with a passageway 130 having a valve seat 132 formed at the entrance thereof. Solenoid operated valve 14 includes a valve 134 which cooperates with valve seat 132 to control the flow of gas between chamber 124 and passageway 130. When valve 134 is open, gas flows through passageway 130, a passageway 136, and through a small-diameter opening 138 in orifice screw 38 which is secured in a threaded opening 139.

Thus, when solenoid operated valves 12 and 14 are energized, gas flows from inlet conduit 36 through opening 66, chamber 72, past regulator valve 76 and its seat 74, into valve chamber 88, through passageway 90, chamber 110, passageways 114 and 120, chamber 124, passageways 130 and 136, and opening 138 in orifice screw 38 to the burner. Under normal inlet gas pressure, regulator valve 76 is biased downwardly, in reference to FIG. 2, to permit the desired rate of gas flow at the burner. If the inlet pressure increases, the increased pressure acts against regulator diaphragm 80 so as to move valve 76 upwardly. The resulting smaller opening between valve 76 and its seat 74 acts to maintain essentially the same rate of gas flow at the burner. If the inlet pressure decreases, diaphragm 80 and poppet valve 76 are forced downwardly by spring 102. The resulting larger opening between valve 76 and its seat 74 acts to again maintain essentially the same rate of gas flow at the burner.

Referring to solenoid operated valve 12 in FIG. 4, chamber 110 in valve body 16 is covered by a cup-shaped portion 140 of cover plate 18. Located in a groove 142 of valve body 16 and sandwiched between valve body 16 and cover plate 18 is a gas-sealing, compressible ring 144. Preferrably, groove 142 is contiguous with groove 81, which retains diaphragm 80, and ring 144 is integral with diaphragm 80.

Cup-shaped portion 140 of cover plate 18, which is constructed of magnetic material, is provided with a centrally positioned aperture 146 through which a lower open end of a non-magnetic plunger guide sleeve 148 extends. Guide sleeve 148 is provided with a peripheral bead 150 near its open end. Sandwiched between bead 150 and the underside of cup-shaped portion 140 of cover plate 18 is a compressible O-ring 152. A cup-shaped retainer 154 includes an outwardly-extending upper flange 156, which is spot-welded to the underside of cup-shaped portion 140 of cover plate 18, and an inwardly-extending lower flange 158. The vertical distance between flanges 156 and 158 of retainer 154 is somewhat less than the combined thickness of bead 150 and O-ring 152 in its uncompressed state so that when retainer 154 is spot-welded to cup-shaped portion 140, O-ring 152 is compressed so as to provide a gas seal with cup-shaped portion 140 and guide sleeve 148.

The upper end of guide sleeve 148 is closed and extends through aperture 58 in top leg 56 of bracket 50. Sleeve 148 is provided with a peripheral groove 160 which retains a stop member generally indicated at 162. Stop member 162 comprises an outer ring 164 of magnetic material, an inner shade ring 166 of copper, and a central plug 168 of magnetic material. Central plug 168 has a generally hemispherical head 170 flattened somewhat at its lowest portion.

Mounted in guide sleeve 148 for free sliding movement is a plunger 172 of magnetic material. The upper end of plunger 172 is provided with a conical recess 174 which cooperates with head 170 of central plug 168 to center the upper end of plunger 172 in guide sleeve 148. The lower end of plunger 172 extends beyond the open end of guide sleeve 148 and carries valve 118. The lower end of guide sleeve 148 is flared outwardly a small amount to ensure free sliding movement of plunger 172.

A return spring 176 bears at its upper end against upper flange 156 of retainer 154. The lower end of spring 176 is nested in a peripheral groove 178 in plunger 172. Spring 176 urges plunger 172 downwardly so as to normally bias valve 118 on its seat 116. Spring 176 is preferrably of the form having an eccentric coil at one end as shown in U.S. Pat. No. 2,650,617. This form of spring biases the lower end of plunger 172 against one side of guide sleeve 148 so as to reduce chattering of plunger 172 when in an energized position.

Surrounding non-magnetic sleeve 148 and extending upwardly from cup-shaped portion 140 of cover plate 18 to a point slightly below stop member 162 is a sleeve 180 of a material whose magnetic characteristics vary with temperature. Slipped over sleeve 180 and resting on portion 140 of cover plate 18 is a bobbin 182 on which two electrical windings 184 and 186 are wound. Windings 184 and 186 are peripherally encapsulated by any suitable potting material 188.

The provision of two windings on a single bobbin, as well as the provision of a temperature-compensating sleeve, are well known in the art. Briefly, the magnetic flux path extends through cover plate 18, bracket 50, stop member 162, and plunger 172. Both windings 184 and 186 must be energized to generate sufficient flux to lift plunger 172 and open valve 118. Once valve 118 is open, the current in winding 186 is reduced by external electrical circuitry (not shown) to a value which, in conjunction with winding 184, will keep valve 118 open. Sleeve 180, which provides a flux path parallel with plunger 172, exhibits a high magnetic permeability at low temperatures and a low permeability at high temperatures. For example, at high temperatures, the resistance of the copper wire in windings 184 and 186 increases, reducing the ampere-turns thereof. Sleeve 180, however, exhibits a lower permeability, allowing less of the available flux to flow through sleeve 180 and more through plunger 172. In this manner, sleeve 180 is effective to enable valve 118 to be opened at essentially the same voltage, regardless of temperature.

Solenoid operated valve 14 is constructed basically the same as valve 12 except valve 14 has a single winding and does not include a temperature-compensating sleeve.

Referring to valve 14 in FIG. 4, chamber 124 in valve body 16 is covered by a cup-shaped portion 190 of cover plate 18. A plunger guide sleeve 192 extends through a central aperture 194 in portion 190. Guide sleeve 192 is provided with a peripheral bead 196 near its slightly-flared open end. A gas-sealing O-ring 198 is sandwiched between bead 196 and portion 190 and secured therein by a cup-shaped retainer 200.

The closed upper end of guide sleeve 192 extends through aperture 60 in top leg 56 of bracket 50. Sleeve 192 is provided with a peripheral groove 202 which retains a stop member 204 comprising an outer ring 206, an inner shade ring 208, and a central plug 210 having a head 212.

Mounted in guide sleeve 192 is a plunger 214, the upper end of which has a conical recess 216 which cooperates with head 212 of central plug 210, and the lower end of which carries valve 134. A return spring 218 biases plunger 214 downwardly so as to normally bias valve 134 on its seat 132.

Slipped over guide sleeve 192 is a bobbin 220 on which is wound an electrical winding 222. Winding 222 is encapsulated by any suitable potting material 224.

Should it become necessary to replace winding 222 and/or combined windings 184 and 186, replacement is simple and safe. Specifically, to replace a defective winding, screw 48 is removed, permitting bracket 50 to be removed. The encapsulated bobbin containing the defective winding is then lifted from its guide sleeve and the appropriate new encapsulated bobbin containing the new winding or windings is placed on the proper guide sleeve. Bracket 50 is then positioned to cause guide sleeve 148 and 192 to extend through apertures 58 and 60, respectively. It should be noted that the resilient mounting of guide sleeves 148 and 192, due to utilization of O-rings 152 and 198, respectively, allows some lateral movement thereof without causing gas to leak from valve body 16. If the windings have been replaced correctly, the above positioning of bracket 50 will also cause projecting boss 64 of bobbin 182, shown in FIG. 2, to be aligned with aperture 62 in top leg 56 of bracket 50. Bracket 50 is then re-attached to valve body 16 by screw 48.

Figure 7:
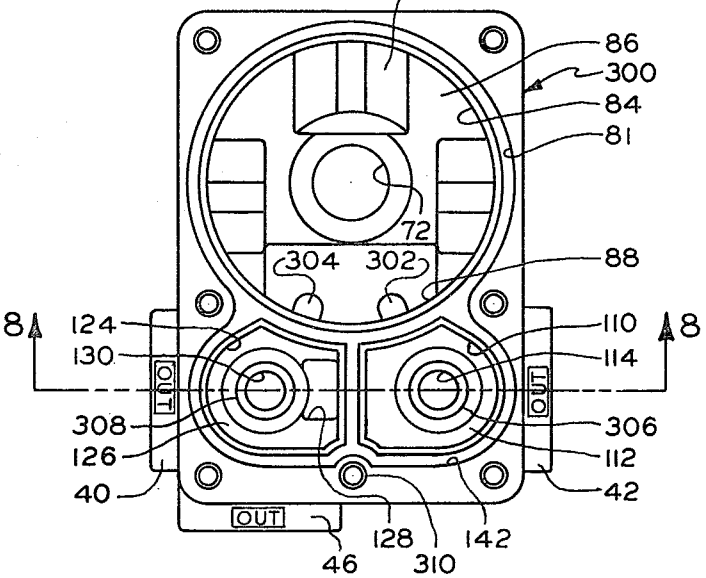
FIG. 7 is a top plan view of the valve body of FIG. 5 shown before being machined.
Figure 8:
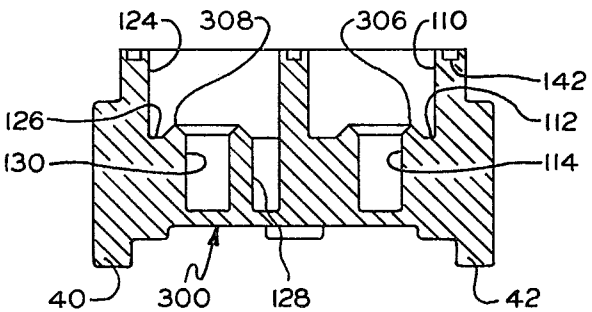
FIG. 8 is a cross-sectional view taken along line 8—8 of FIG. 7.
Figure 5:
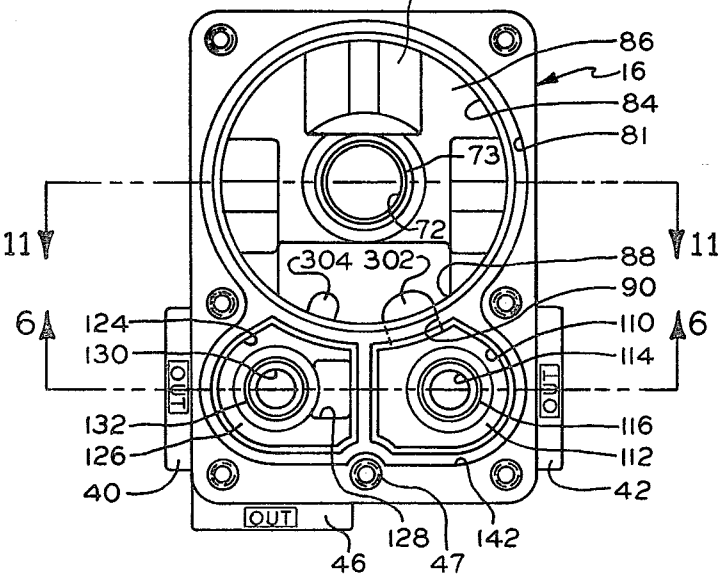
FIG. 5 is a top plan view of the valve body utilized in the valve of FIG. 1.
Figure 6:
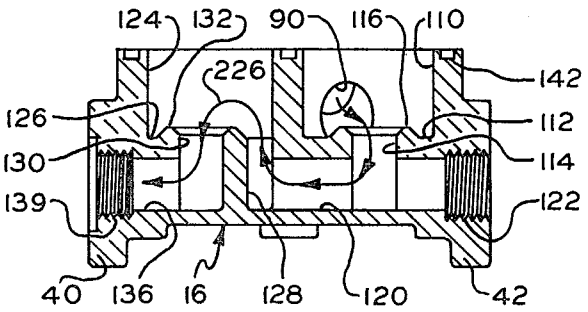
FIG. 6 is a cross-sectional view taken along line 6—6 of FIG. 5.

FIGS. 5 and 6 are a top plan view and a cross-sectional view, respectively, of valve body 16. FIGS. 7 and 8 are similar views of a rough casting 300 used to produce valve body 16. A particular feature of this invention, which will now be described, is that the amount of machining of casting 300 to produce valve body 16 is minimal.

Referring to FIG. 7, casting 300 is provided with outlet bosses 40, 42, and 46. Casting 300 is also provided with chamber 72 and chamber 84, including bosses 106 which project upwardly from bottom wall 86 of chamber 84. Casting 300 is further provided with two peripherically-shaped bosses 302 and 304, for a reason hereinafter described, which project upwardly from bottom wall 86 to chamber 84 and are contiguous with side wall 88 of chamber 84.

Casting 300 is provided with chamber 110 and passageway 114. The bottom wall 112 of chamber 110 is provided with a valve seat portion 306. Casting 300 is further provided with chamber 124, including recessed opening 128 in bottom wall 126 of chamber 124. Also provided in casting 300 is passageway 130 and a valve seat portion 308.

Casting 300 is provided with grooves 81 and 142 which, as previously described, are contiguous and accept the integral diaphragm 80 and ring 144. Finally, casting 300 is provided with a cored inlet opening (not shown) and a plurality of small circular depressions 310 near the peripheral edges thereof.

It should be noted that casting 300 is quite small, measuring approximately $2\frac{1}{2}$ inches $\times 3\frac{3}{8}$ inches $\times 1\frac{3}{8}$ inches. Such a small casting, as compared to the larger size castings for know prior art valves incorporating the same functions, enables a larger number of cavities to be provided in a given size of die frame, thus resulting in a less expensive casting.

To produce valve body 16 from rough casting 300, chamber 72 is machined to provide ledge 73 which retains valve seat 74. Passageway 90 is drilled through boss 302 and wall 88 so as to extend into chamber 110. It is noted that boss 302 provides a surface normal to the drilling angle so as to facilitate drilling passageway 90. Such boss construction is more clearly shown for boss 304 in FIG. 11. Valve seat portions 306 and 308 are machined to provide valve seats 116 and 132, respectively. Depressions 310 are drilled and tapped to provide threaded apertures 47 for accepting screws 20, 22, and 48. The cored inlet opening is threaded to accept inlet conduit 36. Boss 40 of casting 300 is drilled, tapped, and spot-faced to provide passageway 136 and threaded opening 139. Boss 42 is drilled and tapped to provide passageway 120 and threaded opening 122.

As previously described in conjunction with FIG. 4, threaded opening 139 receives orifice screw 38 and threaded opening 122 receives pressure tap fitting 44. Therefore, as shown partially at 226 in FIG. 6, the path of gas flow through valve body 16, when solenoid operated valves 12 and 14 are energized, is through passageway 90, chamber 110, passageways 114 and 120, chamber 124, passageways 130 and 136, and opening 138 in orifice screw 38 to the burner. It is to be noted that the spot-facing of boss 40 allows for attachment, such as by staking, of a conventional orifice extension member (not shown) in lieu of attaching orifice screw 38 directly to valve body 16.

An additional feature of this invention, as will now be described, is that minor changes in coring of the rough valve body casting and minor changes in the machining thereof can produce a valve body with a different gas outlet direction.

Figure 10:
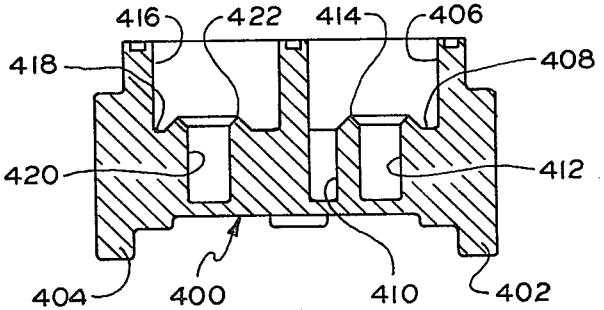
FIG. 10 is a cross-sectional view of the valve body of FIG. 9 shown before being machined.

Referring to FIG. 10, shown therein is a rough casting 400, similar to casting 300 of FIG. 8, used to produce a valve body with a gas outlet at a boss 402, corresponding to boss 42 of casting 300, instead of at boss 404, corresponding to boss 40 of casting 300. As shown therein, casting 400 includes a chamber 406 having a bottom wall 408. Bottom wall 408 is provided with a recessed opening 410. A passageway 412 extends downwardly from bottom wall 408, and a valve seat portion 414 is provided at the entrance of passageway 412. Casting 400 also includes a chamber 416 having a bottom wall 418. A passageway 420 extends downwardly from bottom wall 418, and a valve seat portion 422 is provided at the entrance of passageway 420.

The only difference between casting 400 and casting 300 is that casting 400 has recessed opening 410 and does not have recessed opening 128. All other physical parameters of casting 400 are identical to those of casting 300. It can readily be seen, therefore, that castings 300 and 400 are producible by the same basic tooling, requiring only a simple adding or removing of the coring tooling for recessed openings 128 and 410.

Figure 9:
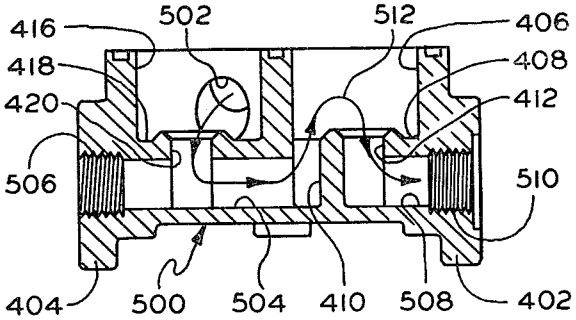
FIG. 9 is a cross-sectional view similar to FIG. 6 for a valve body machined to provide an alternate gas outlet direction.

Shown in FIG. 9 is a valve body 500 produced by machining casting 400 so as to provide a gas outlet at boss 402. As shown therein, valve body 500 is provided with a drilled passageway 502 leading into chamber 416 instead of drilled passageway 90 as in valve body 16. Boss 404 of casting 400 is drilled and tapped to provide a passageway 504 and a threaded opening 506 identical to passageway 120 and threaded opening 122, respectively, in boss 42 of valve body 16. Also, boss 402 is drilled, tapped, and spot-faced to provide a passageway 508 and a threaded opening 510 identical to passageway 136 and threaded opening 139, respectively, in boss 40 of valve body 16. All other machining of casting 400 to produce valve body 500 is identical to that performed on casting 300 to produce valve body 16.

In valve body 500, orifice screw 38 is attached in threaded opening 510 and pressure tap fitting 44 is attached in threaded opening 506 so that, as shown partially at 512 in FIG. 9, the path of gas flow through valve body 500, when valves 12 and 14 are energized, is through passageway 502, chamber 416, passageways 420 and 504, chamber 406, passageways 412 and 508, and opening 138 in orifice screw 38 to the burner.

Figure 12:
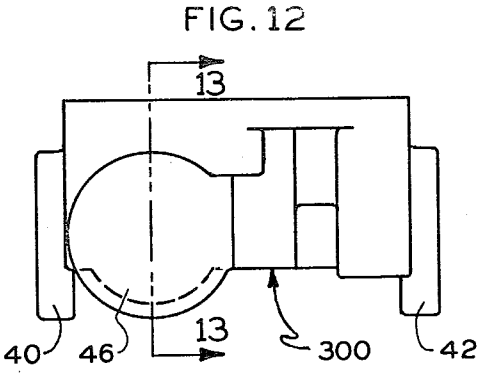
FIG. 12 is a front elevation view of the valve body of FIG. 7.
Figure 14:
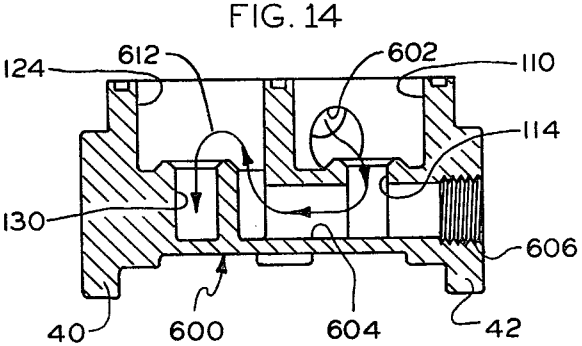
FIG. 14 is a cross-sectional view similar to FIGS. 6 and 9 for a valve body machined to provide yet another alternate gas outlet direction.
Figure 15:
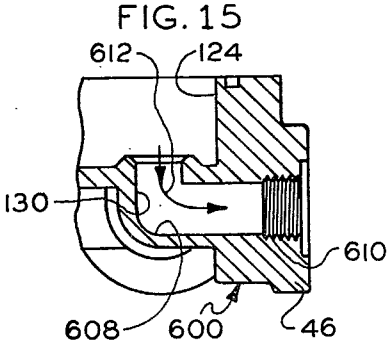
FIG. 15 is a partial cross-sectional view of the valve body of FIG. 13 after being machined to provide the alternate gas outlet direction of FIG. 14.
Figure 13:
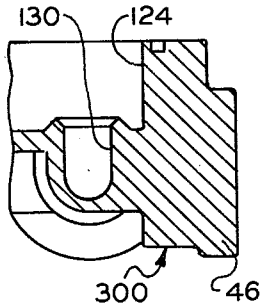
FIG. 13 is a partial cross-sectional view taken along line 13—13 of FIG. 12.

Referring to FIGS. 14 and 15, a valve body 600 is indicated wherein the gas outlet is provided at boss 46. Preferably, the same rough casting 300 used to produce valve body 16, portions of casting 300 being shown in FIGS. 12 and 13, is also used to produce valve body 600, so that the same reference numerals used in describing rough casting 300 will be applicable. The machining of casting 300 to produce valve body 600 is similar to that for producing valve body 16 of FIG. 6. For clarity, however, new reference numerals will be utilized in relation to the machined portions.

Referring to FIG. 14, valve body 600 is provided with a drilled passageway 602, identical to passageway 90, leading into chamber 110. Boss 42 is drilled and tapped to provide a passageway 604 and a threaded opening 606 identical to passageway 120 and threaded opening 122, respectively, in boss 42 of valve body 16. Boss 40 is not machined. Referring to FIG. 15, boss 46 is drilled, tapped, and spot-faced to provide a passageway 608 and a threaded opening 610 identical to passageway 136 and threaded opening 139, respectively, in boss 40 of valve body 16. All other machining to produce valve body 600 is identical to that used to produce valve body 16.

In valve body 600, orifice screw 38 is attached in threaded opening 610 and pressure tap fitting 44 is attached in threaded opening 606 so that, as shown partially at 612 in FIGS. 14 and 15, the path of gas flow through valve body 600, when valves 12 and 14 are energized, is through passageway 602, chamber 110, passageways 114 and 604, chamber 124, passageways 130 and 608, and opening 138 in orifice screw 38 to the burner.

Figure 11:
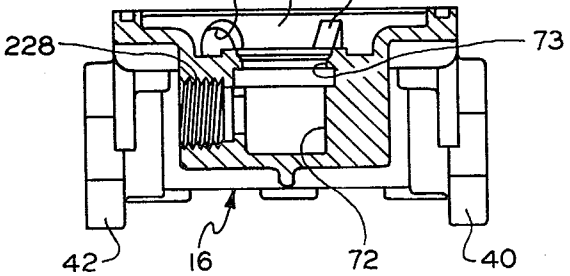
FIG. 11 is a cross-sectional view taken along line 11—11 of FIG. 5.

Referring to FIG. 11, valve body 16 can optionally be provided with a threaded and stepped opening 228 extending into chamber 72 for accepting a pressure tap fitting (not shown). Opening 228, which can also be provided in valve bodies 500 and 600, is utilized to check gas pressure in chamber 72, which pressure is inlet pressure since chamber 72 is upstream of pressure regulator 10.

While a preferred embodiment of the present invention has been illustrated and described in detail in the drawings and foregoing description, it will be recognized that many changes and modifications will occur to those skilled in the art. It is therefore intended, by the appended claims, to cover any such changes and modifications as fall within the true spirit and scope of the invention.

We claim:

1. In a gas valve, a pressure regulator;

two solenoid operated valves;

a valve body comprising a casting selectively cored and machined to effect a desired gas outlet direction;

said casting having a pressure regulator chamber;

said casting having first and second core chambers spaced from each other and from said pressure regulator chamber;

each of said first and second cored chambers having a bottom wall and a cored gas passageway extending downwardly from said bottom wall;

one of said first and second cored chambers being selectively cored to provide a cored recess spaced from said cored gas passageway and extending downwardly from said bottom wall thereof;

said casting having a first gas passageway selectively machined for connecting said pressure regulator chamber to the other of said first and second cored chambers not provided with said cored recess;

said casting having a second gas passageway selectively machined for connecting said cored gas passageway extending downwardly from said bottom wall of said other of said first and second cored chambers to said cored recess of said one of said first and second cored chambers;

said casting having a third gas passageway selectively machined for connecting said cored gas passageway extending downwardly from said bottom wall of said one of said first and second cored chambers to a gas outlet means; and said solenoid operated valves being adapted to control flow of gas out of said first and second cored chambers.

2. The gas valve claimed in claim 1 wherein said second machined gas passageway is adapted to receive a pressure tap.

3. The gas valve claimed in claim 1 further including a cover plate attached to said valve body, means for resiliently mounting said solenoid operated valves to said cover plate, at least one of said solenoid operated valves having a bobbin with a projecting boss, and a bracket attached to said valve body for retaining said solenoid operated valves, said bracket further including an aperture cooperative with said projecting boss.

4. The gas valve claimed in claim 1 wherein said pressure regulator includes a valve seat secured in an aperture in a bottom wall thereof, a plurality of peripherally-spaced bosses projecting upwardly from said bottom wall, a poppet valve cooperative with said valve seat, and a flexible diaphragm connected to said poppet valve and having downwardly-faced projections vertically aligned with said bosses, said bosses and projections being cooperative to prevent downward movement of said diaphragm from effecting a throttling of gas flow past said valve seat.

* * * * *